US010399812B2

(12) United States Patent
Uchida

(10) Patent No.: US 10,399,812 B2
(45) Date of Patent: Sep. 3, 2019

(54) SHEET PROCESSING APPARATUS AND AN IMAGE FORMING APPARATUS

(71) Applicant: CANON KABUSHIKI KAISHA, Tokyo (JP)

(72) Inventor: Yuki Uchida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 212 days.

(21) Appl. No.: 15/642,658

(22) Filed: Jul. 6, 2017

(65) Prior Publication Data

US 2018/0016112 A1 Jan. 18, 2018

(30) Foreign Application Priority Data

Jul. 13, 2016 (JP) ..... 2016-138153

(51) Int. Cl.

| | |
|---|---|
| ***B31F 1/00*** | (2006.01) |
| ***B65H 45/18*** | (2006.01) |
| ***B65H 45/16*** | (2006.01) |
| ***B65H 45/30*** | (2006.01) |
| ***B65H 37/04*** | (2006.01) |
| ***B65H 31/02*** | (2006.01) |

(52) U.S. Cl.

CPC ..... *B65H 45/30* (2013.01); *B31F 1/0012* (2013.01); *B65H 31/02* (2013.01); *B65H 37/04* (2013.01); *B65H 45/162* (2013.01); *B65H 45/18* (2013.01); *B65H 2301/4213* (2013.01); *B65H 2301/42146* (2013.01); *B65H 2511/12* (2013.01); *B65H 2511/13* (2013.01); *B65H 2511/17* (2013.01); *B65H 2511/20* (2013.01); *B65H 2515/112* (2013.01); *B65H 2801/24* (2013.01); *B65H 2801/27* (2013.01)

(58) Field of Classification Search

CPC ..... B65H 45/162; B65H 45/168; B65H 2511/17; B65H 45/30; B31F 1/0012

See application file for complete search history.

(56) References Cited

U.S. PATENT DOCUMENTS

2007/0081847 A1* 4/2007 Acher ..... B42D 5/001 400/621
2011/0245055 A1* 10/2011 Saito ..... B65H 45/18 493/8
2011/0301005 A1* 12/2011 Hattori ..... B31F 1/0012 493/23

FOREIGN PATENT DOCUMENTS

JP 2011-241021 A 12/2011
JP 2015-003796 A 1/2015

* cited by examiner

*Primary Examiner* — Jennifer E Simmons
(74) *Attorney, Agent, or Firm* — Venable LLP

(57) ABSTRACT

Disclosed is a sheet processing apparatus which includes: a supporting portion in which a sheet which has been conveyed is stacked; a pushing member configured to push the sheet with an abutting portion of the pushing member in order to fold the sheet supported on the supporting portion; and a setting portion configured to set a pushing position at which the pushing member pushes the sheet with a score to a position at which the sheet is to be folded at the score, wherein a center of the abutting portion does not coincides with a center of the score of the sheet.

9 Claims, 18 Drawing Sheets

FIG. 15B

| | BASIS WEIGHTS (g/m2) | 100 | | 200 | | 300 | |
|---|---|---|---|---|---|---|---|
| | THICKNESSES | 0. 1 | | 0. 2 | | 0. 3 | |
| | EFFECT | SCORE REVERSION | FOLDING POSITION MISALIGNMENT | SCORE REVERSION | FOLDING POSITION MISALIGNMENT | SCORE REVERSION | FOLDING POSITION MISALIGNMENT |
| DEVIATION AMOUNTS | 0 ~ 0. 25 | × | ◎ | × | ◎ | × | ◎ |
| | 0. 25 ~ 0. 5 | ○ | ◎ | ○ | ◎ | ○ | ◎ |
| | 0. 5 ~ 1. 0 | ◎ | ◎ | ◎ | ◎ | ◎ | ◎ |
| | 1. 0 ~ 1. 25 | ◎ | ○ | ◎ | ○ | ◎ | ○ |
| | 1. 25 ~ 1. 35 | ◎ | × | ◎ | ○ | ◎ | ○ |
| | 1. 35 ~ 1. 45 | ◎ | × | ◎ | × | ◎ | ○ |
| | 1. 45 ~ 1. 55 | ◎ | × | ◎ | × | ◎ | ○ |
| | 1. 55 ~ | ◎ | × | ◎ | × | ◎ | × |

SHEET PROCESSING APPARATUS AND AN IMAGE FORMING APPARATUS

BACKGROUND OF THE INVENTION

Field of the Invention

The present invention relates to a sheet processing apparatus for folding a sheet on which an image is formed, and an image forming apparatus using the sheet processing apparatus.

Description of the Related Art

In recent years, a sheet processing apparatus has been developed which performs post-processing for a sheet on which an image has been formed as an option of an image forming apparatus such as an electro-photographic copying machine and a laser beam printer. This type of sheet processing apparatus has been able to perform various kinds of sheet processing such as stacking and aligning of a plurality of sheets, producing a sheet bundle or a book by providing a stapler for stapling the sheets and a folding device and so on.

As a configuration of folding sheets in such a sheet processing apparatus, the configuration is widely known in which a sheet bundle is pushed into a nip of a roller pair with a thin plate-like pushing member and the sheet bundle is folded by the roller pair, thereby making a booklet as disclosed for example in Japanese Patent Application Laid-Open No. 2011-241021.

Further, in a case where a sheet bundle is pushed and folded by the pushing member as described above, especially when a thick coated paper is pushed and folded, a problem may occur that the outer back portion of the folded sheet is broken (hereinafter referred to as back cracking). In order to prevent back cracking, it is also widely known to carry out a scoring process in which the folding line portion of the sheet is squeezed linearly in advance. As shown in FIG. 17, the squeezing process is generally performed such that when the sheet is folded, the convex portion of the folding score S-C is placed inside the folded sheet.

In order to place the convex portion of the folding score inside the folded sheet as explained above, the convex portion of the folding score should be pushed into a roller nip by the pushing member. At this time, so-called score reversion may occur by which the convex portion of the folding score may be collapsed by being pushed by the pushing member. When the score reversion occurs, the scoring as countermeasures against the back cracking does not exhibit its effect, causing the back cracking.

SUMMARY OF THE INVENTION

A sheet processing apparatus according to the present invention, comprising:

a supporting portion on which a sheet which has been conveyed is supported;

a pushing member configured to push the sheet with an abutting portion of the pushing member in order to fold the sheet on the supporting portion; and a setting portion configured to set a pushing position at which the pushing member pushes the sheet with a score to a position at which the sheet is to be folded at the score, wherein a center of the abutting portion does not coincide with a center of the score of the sheet.

Further features of the present invention will become apparent from the following description of exemplary embodiments with reference to the attached drawings.

BRIEF DESCRIPTION OF THE DRAWINGS

FIGS. 15A and 15B are diagrams effective ranges of pushing positions.

DESCRIPTION OF THE EMBODIMENTS

Next, embodiments of a sheet processing apparatus according to the present invention will be explained as well as an image forming apparatus using the sheet processing apparatus.

<Overall configuration of the image forming apparatus>

Figure 1:
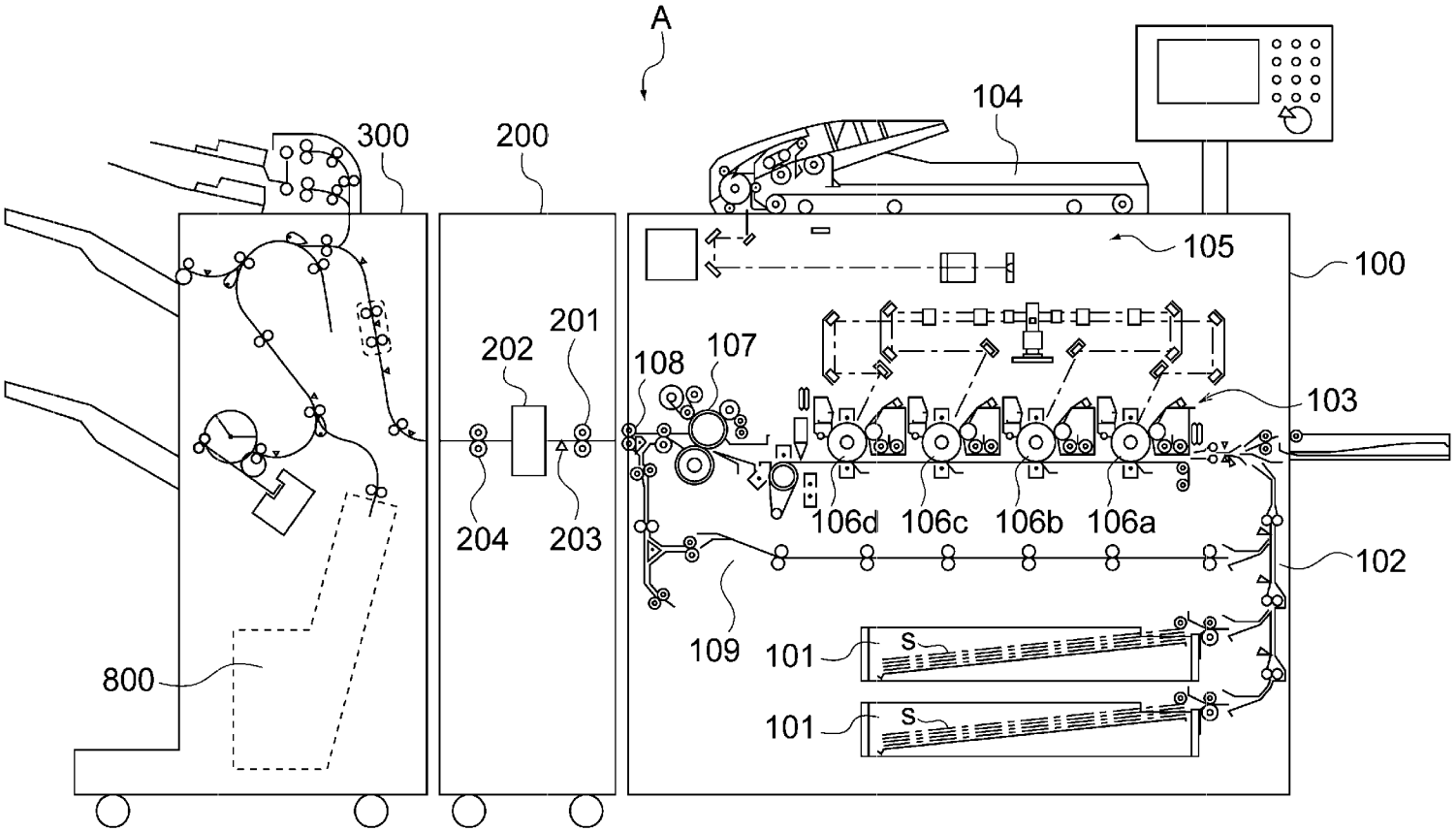
FIG. 1 is a cross-sectional view of an image forming apparatus including a sheet processing apparatus according to the present invention.
Figure 2A:
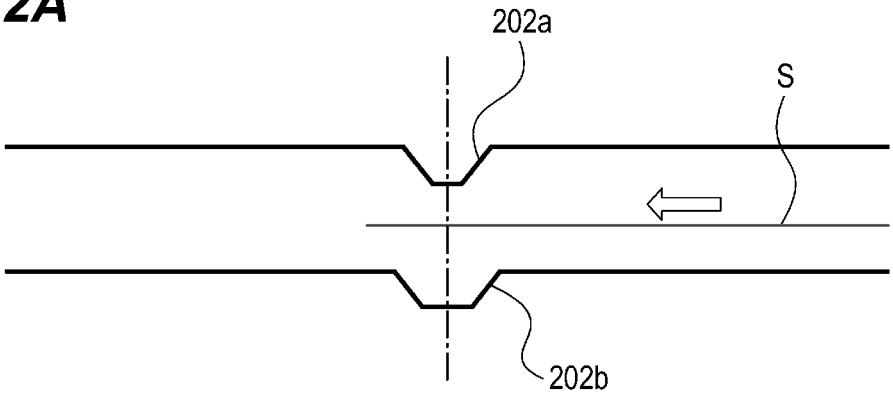
FIGS. 2A, 2B and 2C are explanatory diagrams of a score processing portion.
Figure 2B:
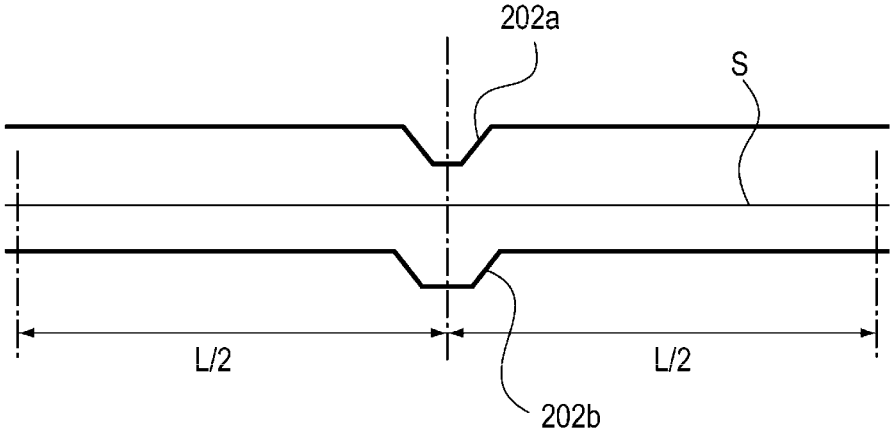

FIG. 1 is a schematic cross-sectional view of an image forming apparatus to which a sheet processing apparatus is attached. FIG. 2 is a schematic view of a scoring device. FIG. 3 is a schematic sectional view of the sheet processing apparatus. The image forming apparatus according to the present embodiment includes an image forming apparatus main body and a sheet processing apparatus which processes a sheet on which an image has been formed by the image forming apparatus main body. As the image forming apparatus main body, a copying machine, a printer, a facsimile and so on are used, but in the present embodiment, a copying machine is exemplified.

As shown in FIG. 1, the image forming apparatus A includes the image forming apparatus main body 100 for forming an image on the sheet S, the scoring device 200 for applying a scoring process to a sheet and the sheet processing apparatus 300 for performing a folding process and so on to a sheet after an image has been formed. The scoring device 200 and the sheet processing device 300 of the present embodiment are configured to be attachable to and detachable from the image forming apparatus main body 100 and can be used as an option for the image forming apparatus main body 100 which can also be used alone.

In the present embodiment, the scoring device 200 and the sheet processing apparatus 300 both of which are attachable and detachable, but these may be integrated with the image forming apparatus main body 100.

<Image forming apparatus main body> The image forming apparatus main body 100 includes the sheet storage portion 101 for storing the sheets S, the sheet feeding portion 102 for feeding the sheets S stored in the sheet storage portion 101, and the image forming portion 103 which forms an image on the sheet S fed by the sheet feeding portion 102. Further, on the upper portion of the image forming apparatus main body 100, the original document feeding device 104 for feeding an original document and the image reader 105 for reading the information of the original document fed from the original document feeding device 104 are provided.

The image forming portion 103 includes four photosensitive drums 106*a* to 106*d* on which toner images of respective colors of yellow, magenta, cyan, and black are formed. The toner image of each color formed on the photosensitive drums 106*a* to 106*d* is transferred to the sheet S. As a result, an unfixed toner image is formed on the sheet S. Thereafter, the unfixed toner image is fixed by the fixing portion 107, and the sheet S is discharged to the sheet processing apparatus 300 by the discharging roller 108.

In the case of duplex printing, the sheet S is reversed by the reverse conveyance portion 109 and is conveyed again to the image forming portion 103 where an image is formed on the reverse side.

<Scoring device> The scoring device 200 forms a folding score on the sheet S by a squeezing process. As indicated in FIG. 1, the sheet S on which an image has been formed is conveyed to the folding score processing portion 202 by the conveying rollers 201. As shown in FIG. 2A, the folding score processing portion 202 includes the convex side scoring portion 202*a* and the concave side scoring portion 202*b* both of which are opposed to each other. The sheet S on which an image has been formed is conveyed between the convex side scoring portion 202*a* and the concave side scoring portion 202*b*. At this time, the sheet is detected by the position sensor 203, and the sheet is conveyed and precisely positioned such that the position at which the folding score is placed, namely, the position of the center (the positon of L/2) in the sheet conveying direction is located at the position at which the convex side scoring portion 202*a* and the concave side scoring portion 202*b* are opposed (FIG. 2B).

Figure 2C:
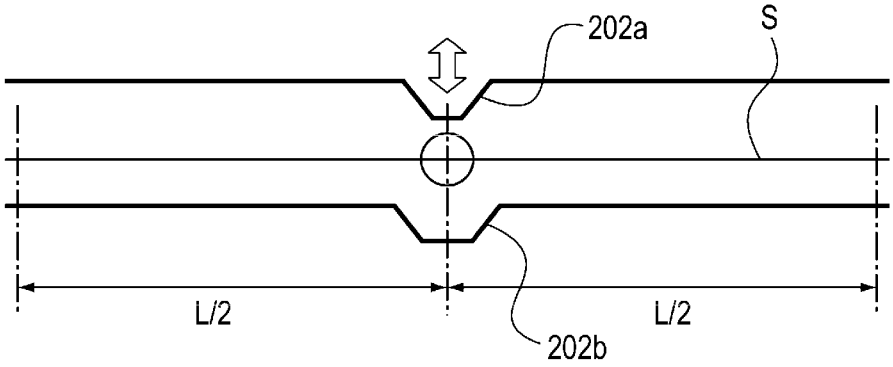
Figure 3:
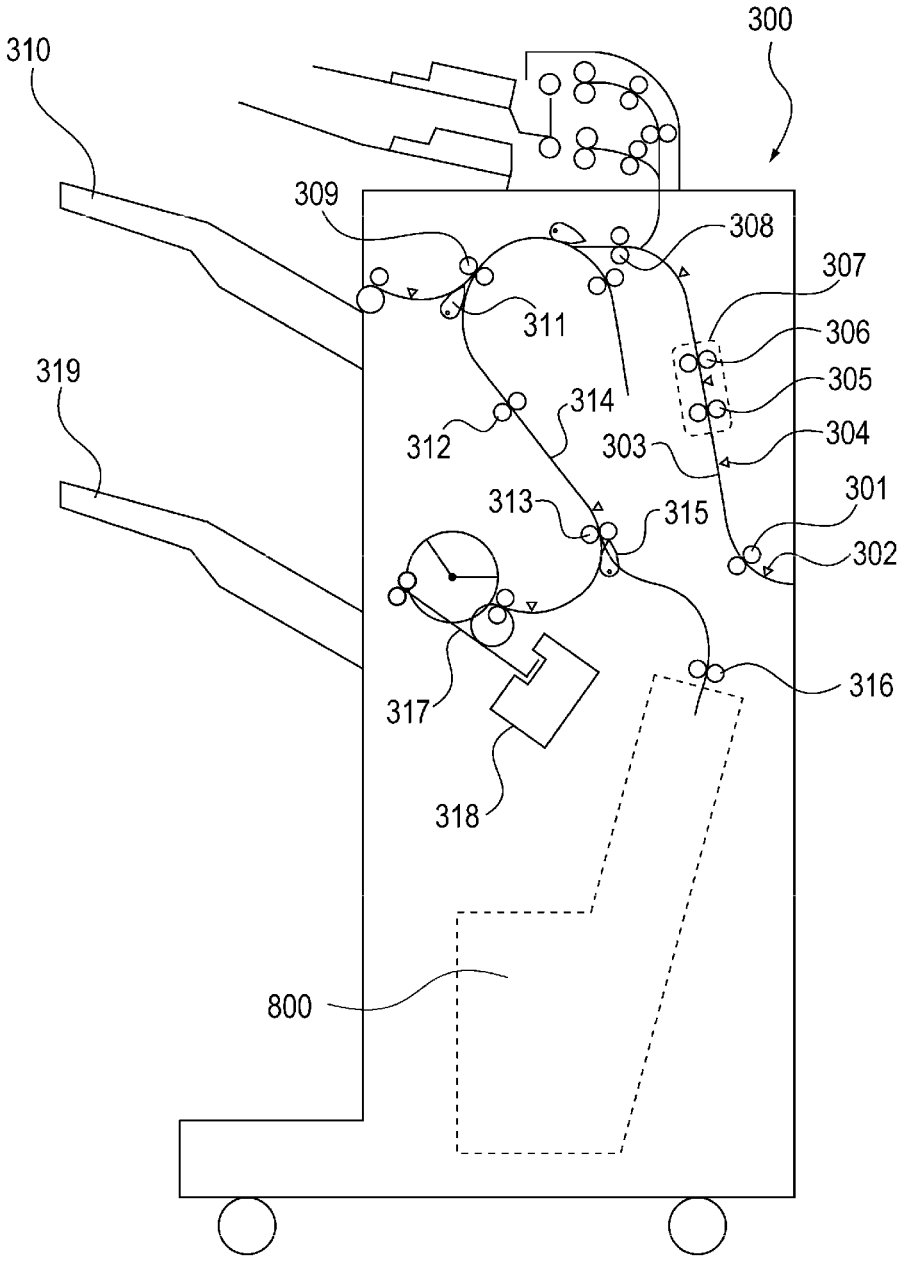
FIG. 3 is a cross-sectional view showing a sheet processing apparatus.

After the sheet has been conveyed to a predetermined position, the convex side scoring portion 202*a* descends in the direction of the arrow shown in FIG. 2C, and the scoring process is performed on the sheet S. After the convex side scoring portion 202*a* has been retracted, the sheet S is conveyed by the conveying rollers 204 and delivered to the sheet processing apparatus 300.

As described above, the scoring device 200 can apply a scoring process to the center of the sheet S in the conveying direction of the sheet S. The scoring device 200 operates when applying a folding score to a sheet and a sheet only passes through the scoring device 200 when not applying a folding score to the sheet.

<Sheet processing apparatus> Next, the sheet processing apparatus 300 will be explained. The sheet processing apparatus 300 is disposed on the downstream side of the image forming apparatus main body 100 and the scoring device 200 in the sheet conveying direction. The sheet processing apparatus 300 receives a plurality of sheets S fed from the image forming apparatus main body 100 and performs staple processing, saddle processing and the like on line.

As shown in FIG. 3, the sheet S fed from the image forming apparatus main body 100 is first delivered to the entrance roller pair 301 of the sheet processing apparatus 300. At this time, the delivery timing of the sheet S is also detected simultaneously by the entrance sensor 302. While the sheet S conveyed by the entrance roller pair 301 passes through the conveying path 303, the end position of the sheet S is detected by the side registration detecting sensor 304. The side registration detecting sensor 304 detects how much side registration error of the sheet S occurs with respect to the center position.

When the side registration error is detected by the side registration detecting sensor 304, the shift processing is performed in which the shift unit 307 moves the sheet by a predetermined amount in the backward direction or in the forward direction while the sheet S is being conveyed by the shift roller pairs 305, 306. By this shift processing, the sheet is aligned in the width direction (the direction orthogonal to the sheet conveying direction). When the shift processing by the shift unit 307 is completed, the sheet S is conveyed by the conveying roller pair 308 and further conveyed to the downstream side by the buffer roller pair 309.

Here, when the sheet S is to be discharged to the upper stacking tray 310, the sheet S is discharged to the upper stacking tray 310 by switching of the upper path switching member 311. On the other hand, when the sheet S is not to be discharged to the upper stacking tray 310, the sheet S passes through the bundle conveying path 314 by the buffer roller pair 312 and the bundle conveying roller pair 313.

In the case of saddle bind processing, the sheet S sent to the bundle conveying path 314 is conveyed to the saddle path by switching the saddle path switching member 315, and is introduced to the saddle unit 800 by the saddle entrance roller pair 316 where saddle bind processing is performed. The saddle unit 800 will be explained later in detail.

On the other hand, when the saddle bind processing is not to be performed, the sheet S is sent to the processing tray 317 by the switching of the saddle path switching member 315. At this time, when bind processing is to be performed, the bind processing is performed by the stapling portion 318. When the bind processing is not to be performed by the stapling portion 318, the sheet S is discharged to the lower stacking tray 319 without passing through the processing tray 317.

<Control portion> Next, the configuration of the control portion for controlling the image forming apparatus A according to the present embodiment will be explained with reference to the block diagram of FIG. 4.

Figure 4:
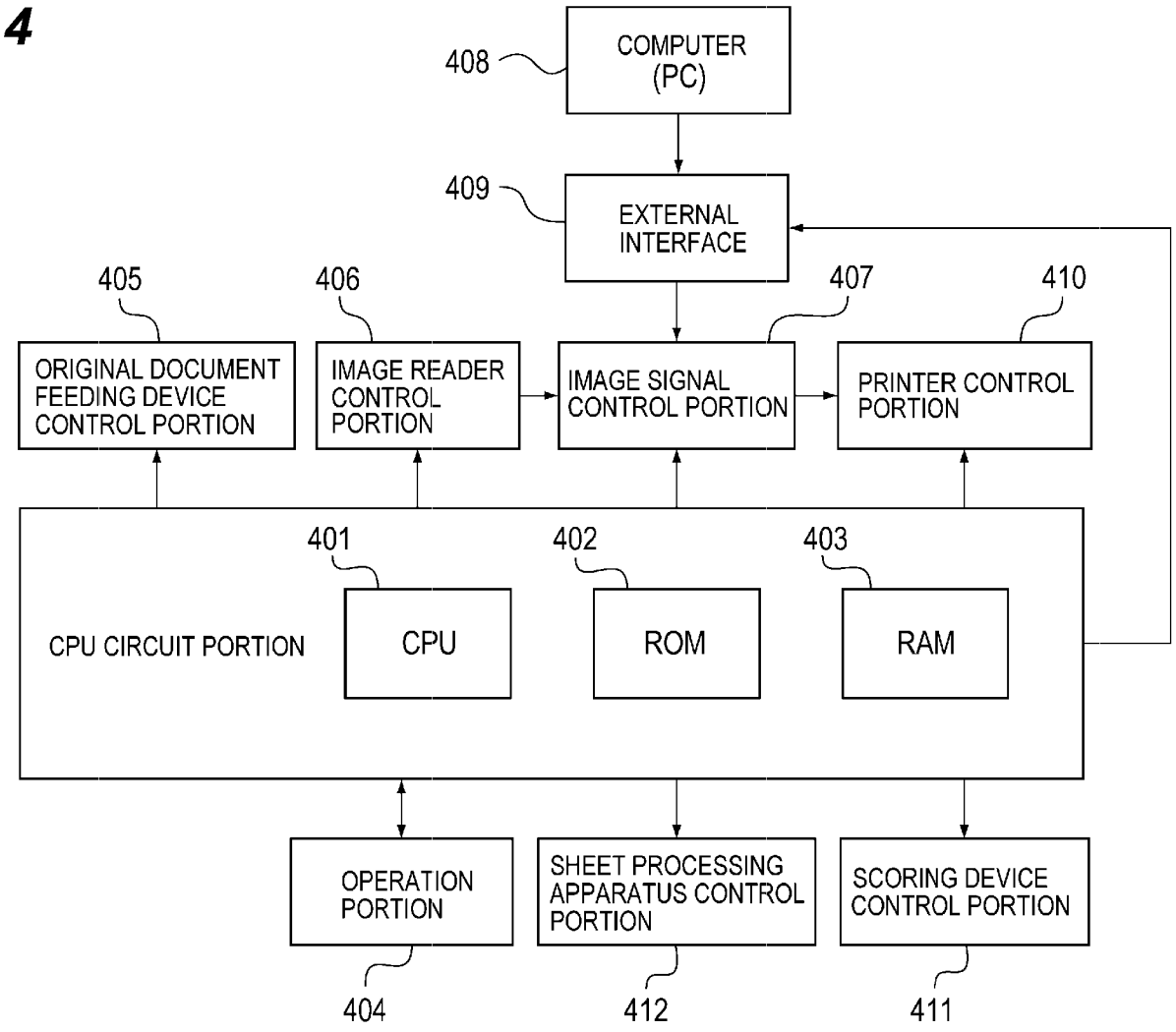
FIG. 4 is a system block diagram.

As shown in FIG. 4, the CPU 401 which performs basic control of the image forming apparatus A is connected with the ROM 402 in which a control program is stored and the RAM 403 for serving as a working area for performing processing. In the case of a copy mode, upon receiving a start signal or the like from the operation portion 404, the CPU 401 controls the driving of the original document feeding device 104 via the original document feeding device control portion 405, controls the reading of an image of an original document with the image reader 105 by controlling the image reader control portion 406, and sends the reading information to the image signal control portion 407. In the case of a print mode, an image signal is inputted to the image signal control portion 407 via the external interface 409 from the external computer 408. Then, in response to the image signal from the image signal control portion 407, the printer control portion 410 drives and controls the image forming portion 103 to form an image and drives and controls the sheet feeding portion 102 and the like to record the image on the conveyed sheet.

Further, the CPU 401 sends driving signals to the scoring device control portion 411 which controls the driving of the scoring device 200, and to the sheet processing apparatus control portion 412 which controls the driving of the sheet processing apparatus 300 to control them.

Further, the sheet processing apparatus control portion 412 controls driving sources such as a motor for moving the pushing member which will be explained later, a motor for driving the folding roller and a motor for driving the sheet conveying roller, and a sensor for detecting the position of a conveyed sheet.

<Saddle unit> Next, the configuration of the saddle unit 800 will be explained with the operations of the saddle unit 800 with reference to FIGS. 5, 6, 7A, 7B, 8, 9A, 9B, 9C, 9D and 9E.

Figure 5:
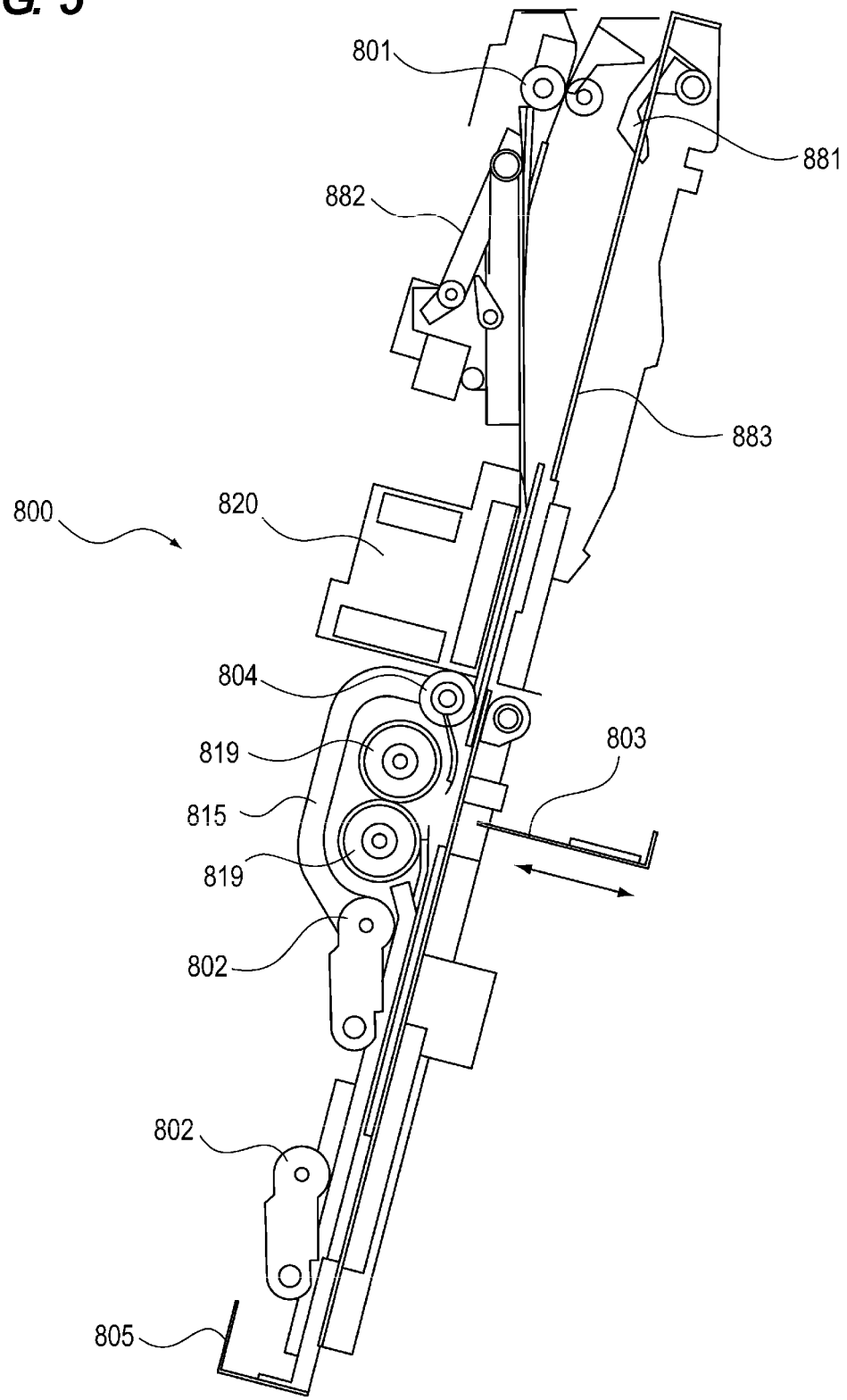
FIG. 5 is a cross-sectional view of a saddle unit.

FIG. 5 is a basic sectional view of the sheet processing portion of the saddle unit 800. In the saddle unit 800, the sheet conveyed by the entrance roller 801 is stacked in the processing tray 883 as a supporting portion. The tip stopper 805 is provided in the lower portion of the saddle unit 800 in order to align in the conveying direction the positions of the sheets supported on the processing tray 883.

Figure 6:
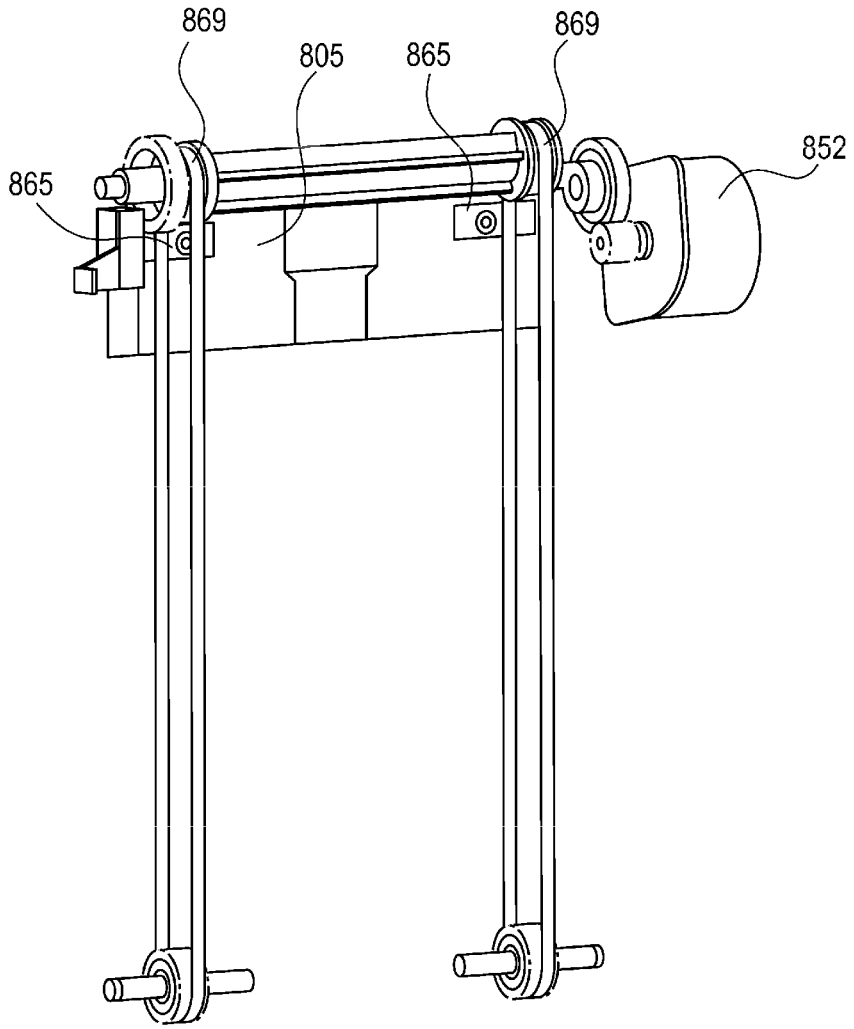
FIG. 6 is an explanatory diagram showing a configuration of a tip stopper.

The tip stopper 805 serves as a regulating portion which supports the tip (lower tip) of the conveyed sheet and positions the sheet in the sheet conveying direction. As shown in FIG. 6, the tip stopper 805 is fixed to the belt member 869 provided along the sheet conveying direction by the fixing portion 865. By moving the belt member 869 with the stopper drive motor 852, the position of the tip stopper 805 is moved. As will be explained later, the position of the tip stopper 805 is adjusted so as to regulate the position of the conveyed sheet such that the position of the folding score formed on the sheet coincides with the pushing position of the pushing member.

Figure 7A:
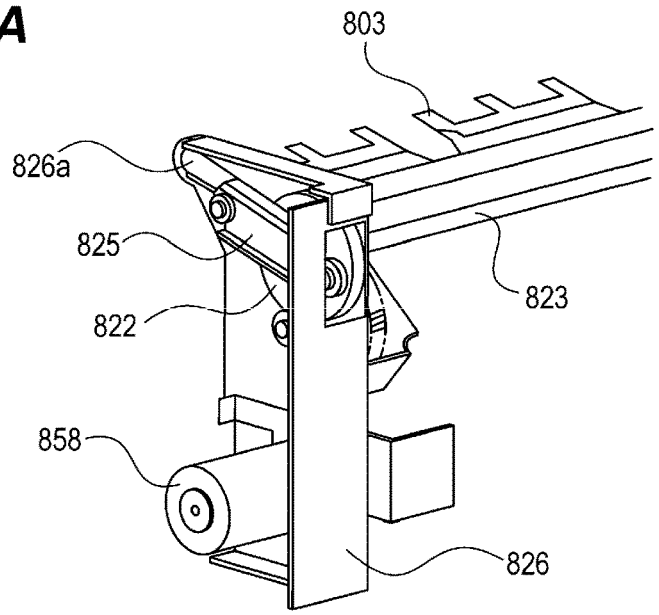
FIGS. 7A and 7B are explanatory diagrams showing a configuration of a pushing plate moving portion.
Figure 7B:
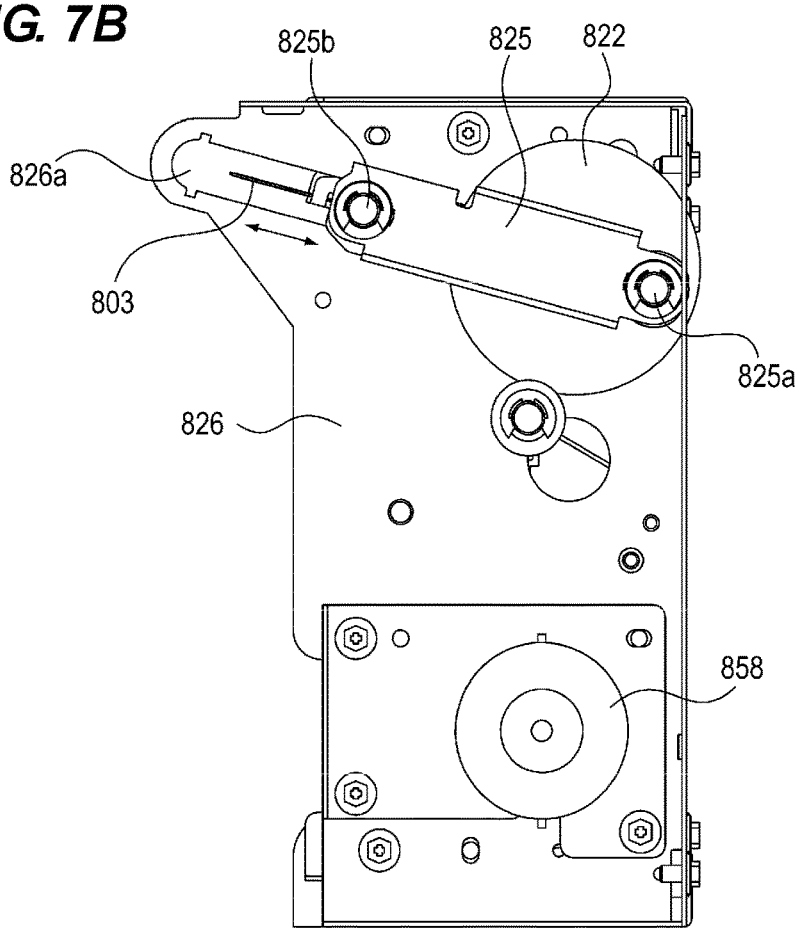

The pushing plate 803 (pushing member) for folding the sheet is provided at a position substantially at the center of the sheet stacked on the processing tray 883 in the conveying direction. As shown in FIG. 7, the pushing plate 803 operates with the pushing drive motor 858 as a driving source. The driving force of the pushing drive motor 858 is transmitted via a gear and a belt (not shown) to the pushing drive gears 822 which are provided on both sides in the sheet width direction and which are connected to each other by the connection shaft 823 (FIG. 7A only shows one side).

The pushing drive gear 822 is engaged with the pushing link plate 825. The pushing link plate 825 has the link engagement portion 825*a* engaged with the pushing drive gear 822 and the pushing plate engagement portion 825*b* engaged with the pushing plate 803. The pushing plate engagement portion 825*b* is guided by the guide portion 826*a* of the pushing frame 826. Thus, the pushing plate 803 is reciprocated by the pushing drive motor 858 while being guided by the guide portion 826*a*.

Figure 8:
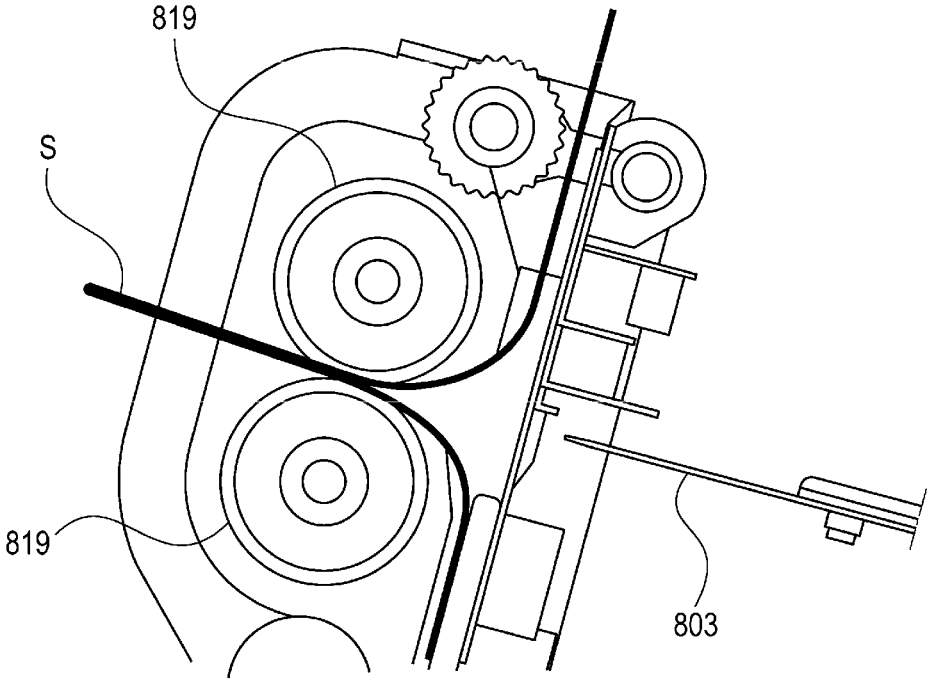
FIG. 8 is an explanatory diagram showing a configuration of a pushing plate and a folding roller.

The folding rollers 819 are provided in the region in which the pushing plate 803 moves. The folding rollers 819 are constituted by a roller pair driven by a drive motor which is not shown. As shown in FIG. 8, the folding rollers 819 folds a sheet bundle in half by pulling the sheet bundle which is pushed into the nip portion by the pushing plate 803.

Figures 9A, 9B, 9C, 9D, 9E:
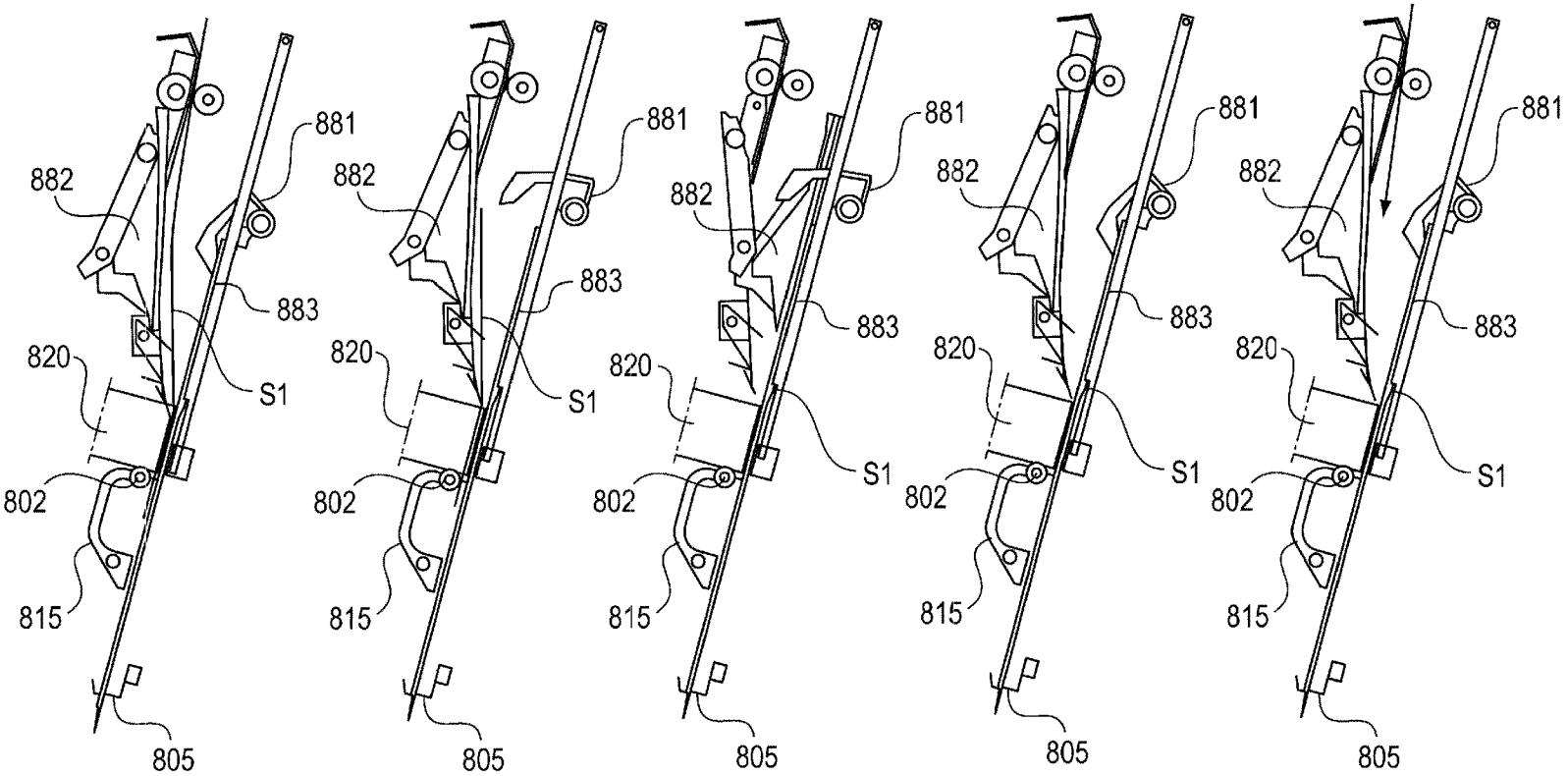
FIGS. 9A, 9B, 9C, 9D and 9E are explanatory diagrams showing a saddle operation.

FIG. 9 is an explanatory diagram of the operation of the saddle unit 800. As shown in FIG. 9A, the tip of the sheet S1 conveyed to the saddle unit 800 by the entrance roller 801 is pushed by the intermediate roller 804 and the aligning roller 802 to the tip stopper 805 which is a restricting portion for positioning a sheet in the conveying direction, thereby aligning the sheet in the conveying direction. Thereafter, the sheet is aligned in the sheet width direction which is orthogonal to the sheet conveying direction by the aligning plate 815.

Then, the rear end holding member 881 is opened as shown in FIG. 9B. Then, the tapping member 882 biases the sheet S1 toward the processing tray 883 as shown in FIG. 9C. Then, the rear end holding member 881 is closed and the tapping member 882 returns to the standby position side as shown in FIG. 9D. In this state, the next sheet can be accepted. By this tapping and holding action, the sheet rear end is biased to the right side in FIG. 9D to avoid collision between the rear end of the already stacked sheet and the front end of the next sheet. This is the rear end sorting. When the rear end sorting is completed, the next sheet S2 is conveyed again by the entrance roller 801 as shown in FIG. 9E.

Thereafter, as in the case of the first sheet S1, the alignment in the conveying direction/orthogonal direction is performed, and the holding member 881 is opened, and the sheet S2 is biased toward the processing tray 883 side by the tapping member 882, and then the holding member 881 is closed. After aligning a sheet, biasing a sheet toward the processing tray, and holding the rear end of a sheet are repeated until the last sheet Sn of the sheet bundle is completed, the bind processing is performed by the stapler 820. The tip stopper 805 waits at a position where the distance between the stapling position and the stopper is half the sheet length and receives the sheet, so that the staple processing is performed at the center of the sheet.

Thereafter, the stapled sheet bundle S is lowered to a predetermined position which is explained later. Then, the sheet bundle S is guided to the nip of the folding rollers 819 by the pushing plate 803, and at the same time, the folding rollers 819 are rotated to create a saddle-processed sheet bundle S as shown in FIG. 8. The operation of the aligning of each sheet, the operation of staple processing on a sheet bundle, and the operation of the fold processing are repeated until the final bundle.

<Pushing position adjustment> In the sheet processing apparatus according to the present embodiment, when pushing and folding a sheet, the pushing position is changed depending on whether a folding score is provided on a sheet or not. Then, when pushing and folding a sheet on which a folding score is formed, the pushing position of the pushing plate 803 is deviated from the center of the folding score. The configuration of the pushing position adjustment will be explained next.

Figure 10:
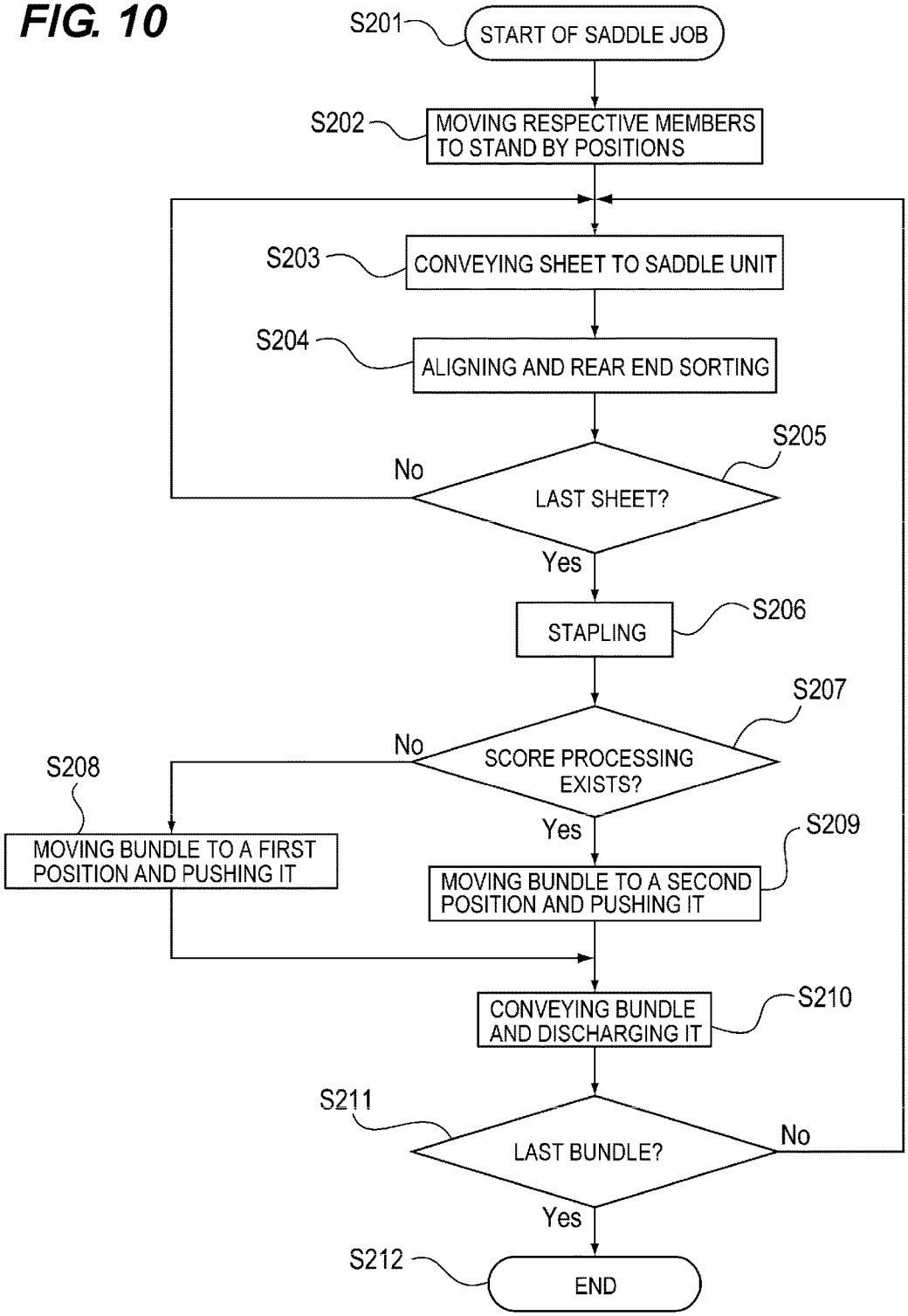
FIG. 10 is a flowchart showing an operation of changing a pushing position of the pushing plate based on absence/presence of folding score.

As shown in the flowchart of FIG. 10, when a saddle job is inputted, the respective members move to standby positions for receiving a sheet (steps S201 and S202). At this time, the aligning plate 815 stands by at a position somewhat wider than the sheet width. The tip stopper 805 stands by at a position located downward from the staple position by half the sheet length as explained above. Thereafter, the sheet delivered to the sheet processing apparatus is conveyed into the saddle unit through the respective conveying rollers (step S203) where the alignment in the sheet conveying direction, the alignment in the sheet width direction, and rear end sorting operation are performed (step S204). The above operations are repeated up to the last sheet of each bundle (step S205). Thereafter, the staple processing is performed by the stapler 820 (step S206). When the sheet bundle includes only one sheet, the staple processing is not performed.

Figure 11:
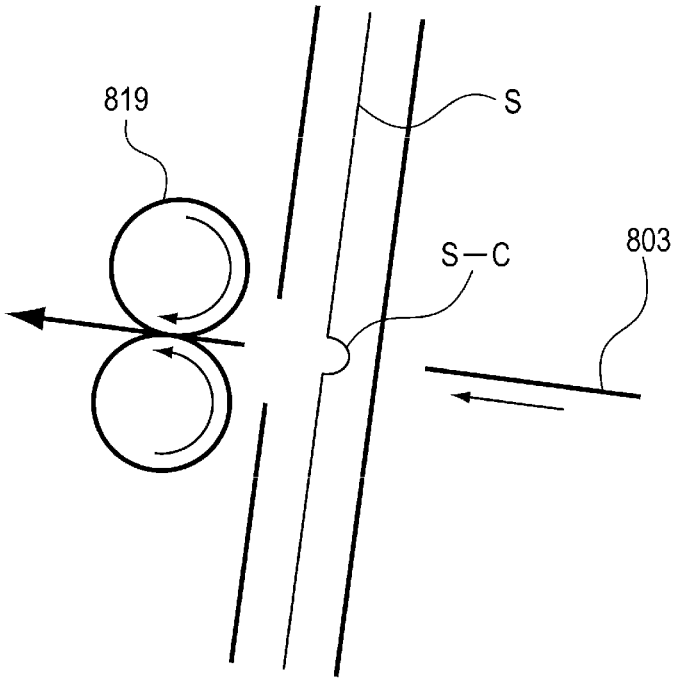
FIG. 11 is an explanatory diagram showing a pushing operation of the pushing plate.

Next, the tip stopper 805 is moved based on the presence/absence of a score. First, it is confirmed whether the folding score S-C as shown in FIG. 11 is formed on the cover sheet of the sheet bundle by the scoring device 200 (step S207). When the score processing is not performed, the tip stopper 805 is moved to the first position (step S208). On the other hand, when the score processing is performed on the cover sheet, the tip stopper 805 is moved to the second position. Then, the pushing operation is performed by the pushing plate (step S209).

In the present embodiment, as explained above, the relative position of the pushing plate 803 with respect to the sheet is changed depending on whether the folding score S-C exists on the cover sheet or not. The pushing position setting mechanism is constituted which sets the pushing position of the pushing plate 803 with respect to the sheet by the position control of the tip stopper 805.

Thereafter, the prepared booklet is conveyed as a bundle and discharged to the tray (step S210). The above operations are continued up to the final bundle and then the job is completed (steps S210, S211 and S212).

The first position is a position where the distance between the center of the pushing plate 803 and the tip stopper 805 is half the sheet length.

The second position is a position where the distance between the center of the pushing plate 803 and the tip stopper 805 is half the sheet length±deviation amount (hereinafter the deviation amount is the distance between the center of the sheet abutting portion of the pushing plate 803 and the center of the folding score S-C). Considering the following two conditions, the folding score pushing position which is a position at which the pushing plate 803 pushes the folding score S-C depending on the deviation amount.

The first condition is that half the thickness of the abutting portion at which the pushing plate 803 abuts against the sheet is less than the deviation amount. That is, the center line of the abutting portion and the center line of the folding score of the sheet are separated from each other by not less than ½ of the thickness of the abutting portion. The abutting portion of the pushing plate 803 is a portion which abuts against the sheet when the pushing plate 803 abuts against the sheet and which is an abutting tip portion of the pushing plate 803.

Figure 12A:
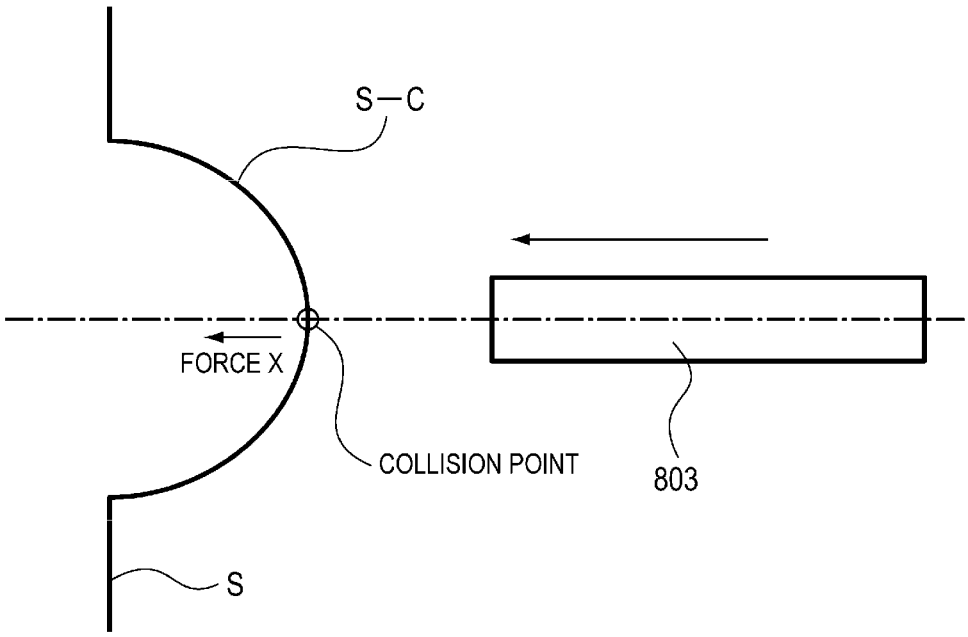
FIGS. 12A and 12B are explanatory diagrams showing a pushing position of the folding score and forces acting on the sheet.

The reason why the first condition should be met will be explained with reference to FIGS. 12A and 12B. As shown in FIG. 12A, when the pushing is performed at a position at which the center line of the abutting portion of the pushing plate 803 coincides with the center line of the folding score S-C, the force X for bending the sheet is transmitted at the collision point.

Figure 12B:
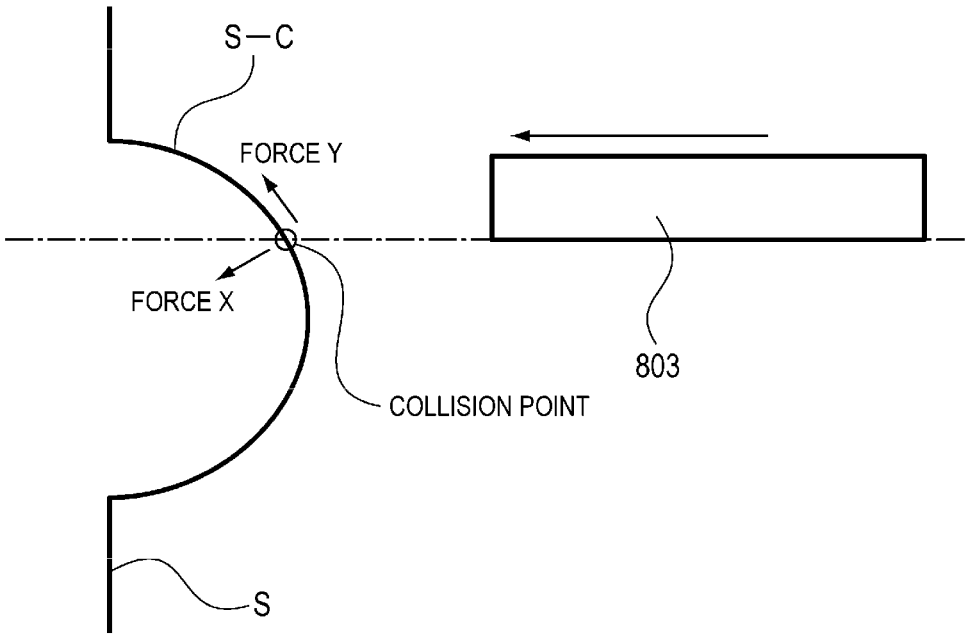

On the other hand, when the centers are displaced from each other, the force Y for compressing the sheet is generated and the force X for bending the sheet decreases for that amount as shown in FIG. 12B. As the amount of deviation is further increased and the collision point approaches the end portion of the folding score S-C, the force X for bending the sheet decreases and the compressing force Y increases.

In general, the sheet-like object is stronger against a force in the compression direction than a force in the bending direction. That is, the deformation of the sheet can be suppressed and score reversion can be reduced by shifting the center of the abutting portion of the pushing plate 803 from the center of the folding score S-C so as to change the force in the bending direction which is transmitted to the sheet into a force in the compression direction thereby reducing the force in the bending direction. In order to shift the collision point of the pushing plate 803 from the center of the folding score S-C, it is necessary that the amount of deviation should be half the thickness of the abutting portion of the pushing plate 803 or more.

Next, the second condition is that the deviation amount should be less than half the width of the folding S-C+half the thickness of the abutting portion of the pushing plate 803.

Figure 13A:
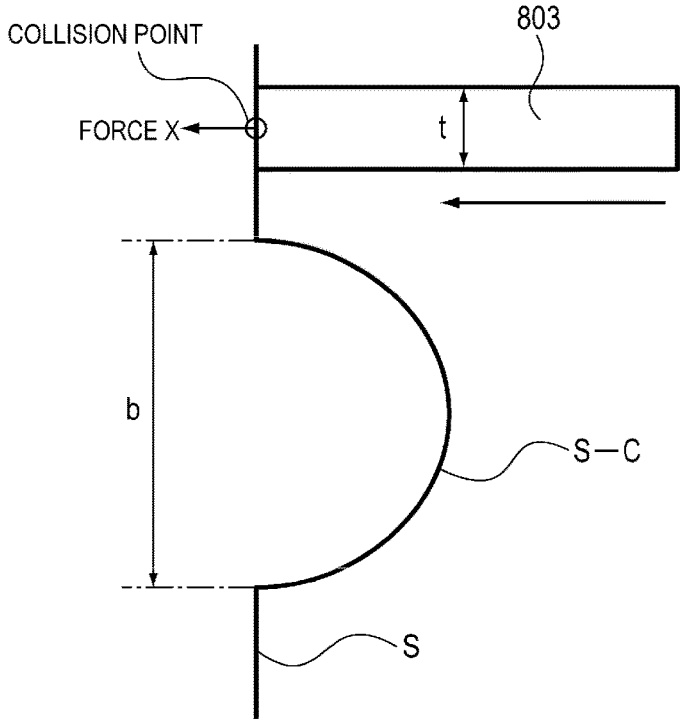
FIGS. 13A and 13B are explanatory diagrams showing a pushing position of the folding score and forces acting on the sheet.
Figure 13B:
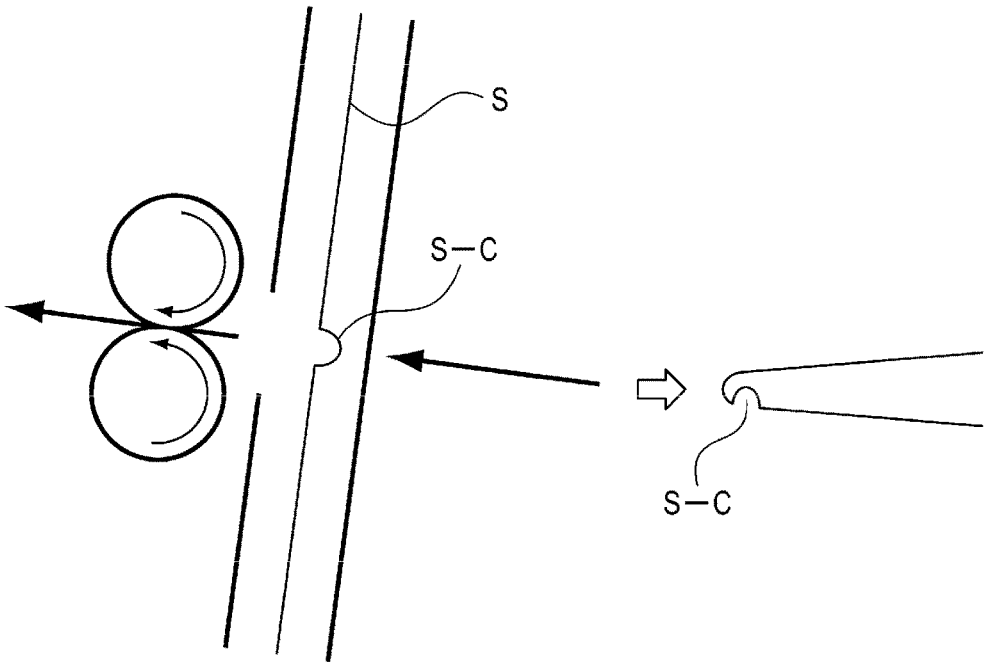

The reason why the second condition should be met will be explained with reference to FIGS. 13A, 13B, 14A and 14B. As shown in FIG. 13A, when the pushing is performed out of the range of the folding score S-C, the force X for bending the sheet is generated at the collision point. Since the sheet deforms at the collision point, the collision point is the folding position. When the deviation amount is too large, a problem occurs in which the folding position does not coincide with the score position as shown in FIG. 13B (hereinafter referred to as folding misalignment). In this case as well, the back cracking will occur.

Figure 14A:
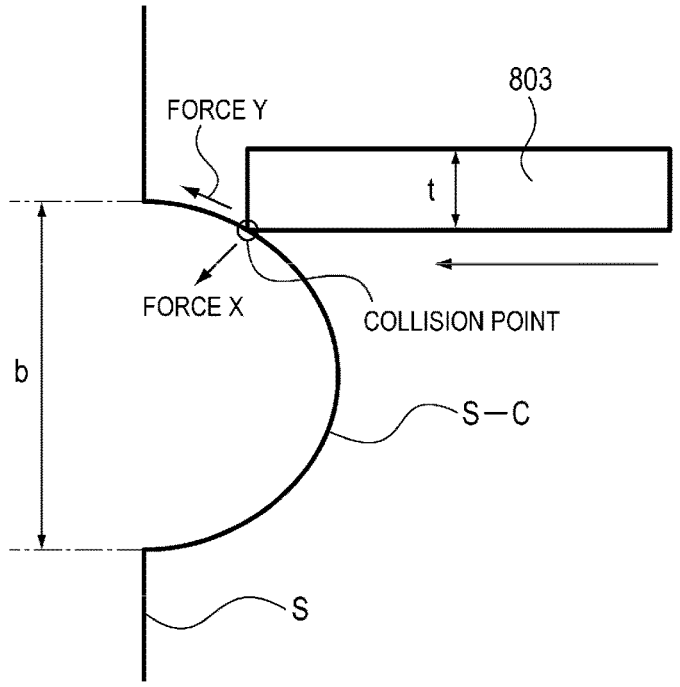
FIGS. 14A and 14B are explanatory diagrams showing a pushing position of the folding score and forces acting on the sheet.

On the other hand, as shown in FIG. 14A, when the collision point is within the range of the folding score S-C, the bending force X decreases because of the generation of the compression force Y and the deformation of the sheet is suppressed as explained above and the sheet is pushed in the direction of the folding rollers 819. In the process of being pressed, the sheet deforms at the center of the folding score S-C and enters the nip portion of the folding rollers 819. Thus, the center of the folding score S-C becomes the folding position.

That is, by taking the collision point within the folding range of the folding score S-C, the center of the folding score S-C can be a folding position. In order to take the collision point within the folding range of the folding score S-C, it is desirable that the deviation amount should be less than half the width of the folding score S-C+half the thickness of the abutting portion of the pushing plate 803.

Figure 14B:
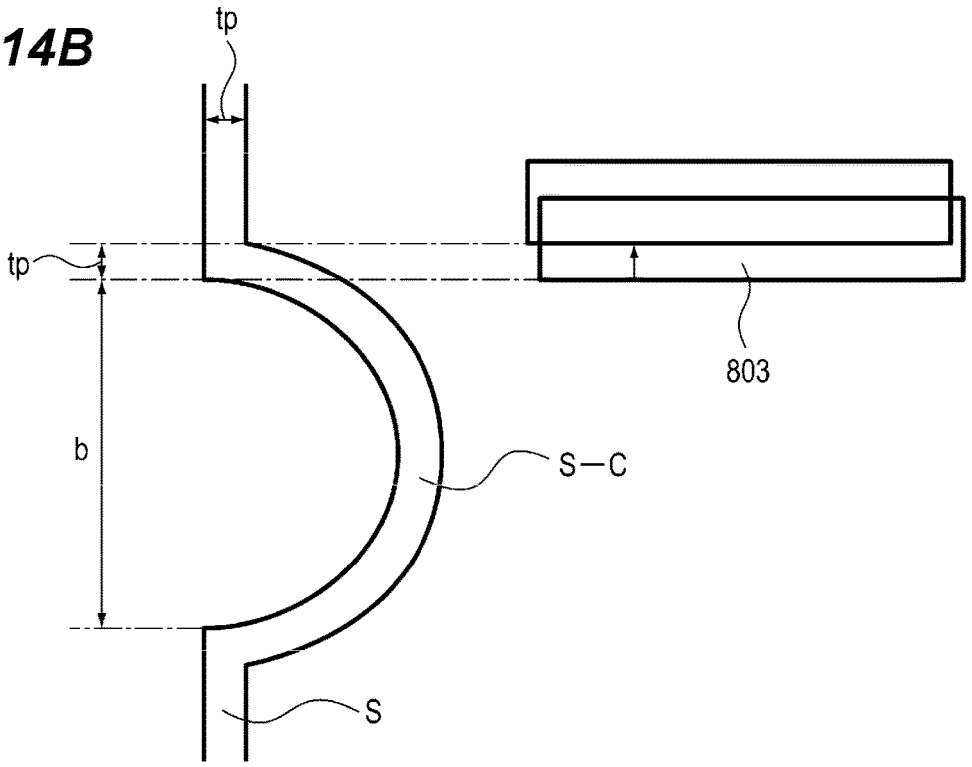

Further, as shown in FIG. 14B, the limit position of the deviation can further be shifted from the center to the outside by the thickness of the sheet in addition to the width of the folding score S-C. For example, in the case of thin paper such as 60 g paper, the limit position almost depends on the width of the folding score S-C, but in the case of thick paper such as 300 g paper, the limit position is influenced by the thickness of the sheet. Therefore, when considering the thickness of the sheet, even if the sheet is further shifted outward by the thickness of the sheet, the collision point of the abutting portion is within the folding range of the folding score S-C.

In summary, given that the thickness of the abutting portion of the pushing plate 803 is t, the width of the folding score S-C is b and the thickness of the sheet is tp, the score reversion can be reduced when t/2 is less than the deviation amount. The misalignment of folding position can be reduced when the deviation amount is less than b/2+t/2+tp. Therefore, the range of the deviation amount in which both problems can be reduced is:

$$t/2 < \text{deviation amount} < b/2 + t/2 + tp \qquad \text{(formula 1).}$$

However, in the case of a thin sheet, the thickness tp of the sheet can be neglected.

Figure 15A:
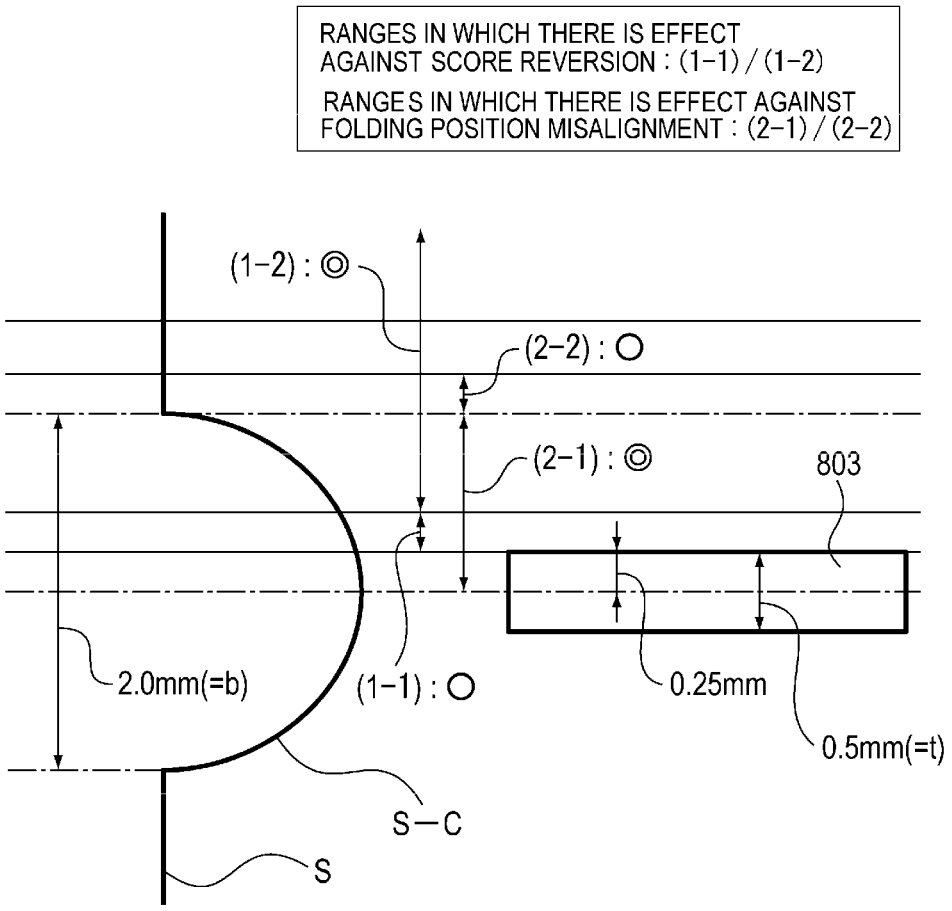

Next, a result of a test in which a sheet with as folding score is pushed and folded using the sheet processing apparatus in the present configuration will be explained with reference to FIGS. 15A and 15B. In FIGS. 15A and 15B, a single circle indicates that there is an effect and a double circle indicates that there is a sufficient effect.

FIG. 15A shows a result of a test performed in which the deviation amount is changed when the pushing plate pushes a sheet and folds it. The abutting portion of the pushing plate has the thickness t of 0.5 mm. As the sheet, a paper of basis weight 100 g/mm$^2$ with a folding score whose width b=2.0 mm is used. In FIG. 15A, indicated by (1-1) and (1-2) are the ranges in which there is an effect against the score reversion. Further, indicated by (2-1) and (2-2) are the ranges in which there is an effect against the folding position misalignment. In the ranges (1-2) and (2-1), a sufficient effect is obtained respectively, and it is preferable to perform the pushing and folding aiming at these ranges. However, when it is difficult to perform the control because the range is too narrow, an effect can be obtained also in the ranges of (1-1) and (2-2).

FIG. 15B shows a result of a test performed in which the deviation amount is changed when the pushing plate pushes three kinds of sheets and folds them. The three kinds of sheets include a sheet whose thickness tp is 0.1 mm (basis weight 100 g/m$^2$), a sheet whose thickness tp is 0.2 mm (basis weight 200 g/m$^2$) and a sheet whose thickness tp is 0.3 mm (basis weight 300 g/m$^2$). On these sheets, a folding score whose width b=2.0 mm is also formed as explained above. Also in this test, the abutting portion of the pushing plate has the thickness t of 0.5 mm as explained above. As can be seen from this result, the larger the basis weight is, the wider the range becomes in which an effect of reducing the folding position misalignment can be obtained. This is also understood from the fact that the thickness tp of the sheet is included in the formula 1.

Therefore, for the purpose of making the control easier, the control may be made so that the deviation amount increases as the basis weight of the sheet increases. The deviation amount does not necessarily have to be strictly within the range of the formula 1, and fluctuation up to the range of about a few tenths of millimeter is within an allowable range. For example, according to the test indicated in FIG. 15B, the deviation amount in the case of the sheet with the thickness tp=0.3 mm is less than b/2+t/2+tp=1.4 mm according to the formula 1. However, there was an effect for reducing the folding position misalignment even in the range of the deviation amount 1.45 to 1.55 mm. That is, it is sufficient if a part of the abutting portion of the pushing plate 803 is within the folding range of the folding score.

By setting the deviation amount such that a part of the pushing member falls within the range of the score as explained above, occurrences of the score reversion and folding position misalignment are suppressed so that a booklet which is folded at a folding score can be obtained.

<Other examples of pushing position setting mechanism> In the above embodiment, an example in which the position of the tip stopper 805 is adjusted is shown as a pushing position setting mechanism for setting the pushing position of the pushing plate 803 with respect to the sheet. By adjusting the position of the tip stopper 805 so that the position of the sheet with respect to the pushing plate 803 is adjusted, the relative position of the butting portion of the pushing plate 803 and the folding score of the sheet is adjusted.

Figure 16A:
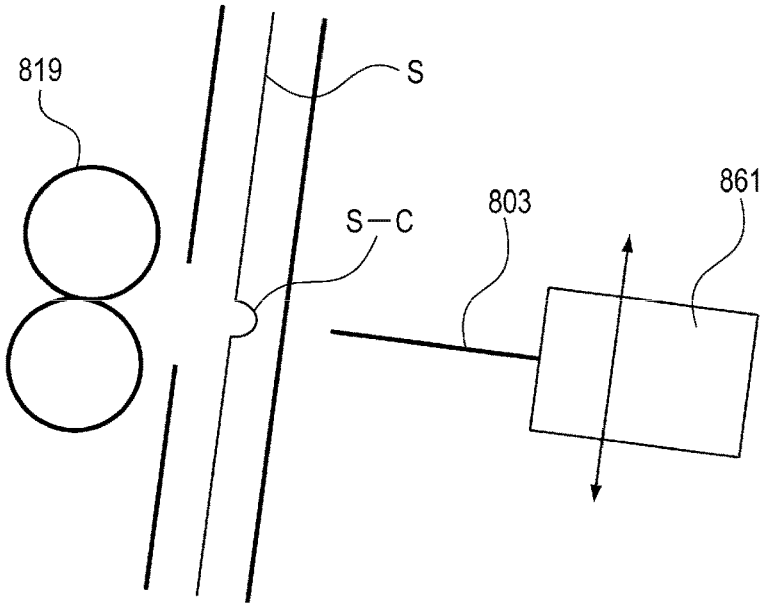
FIGS. 16A and 16B are explanatory diagrams showing another example of a pushing position setting mechanism.

However, as the pushing position setting mechanism, as shown in FIG. 16A, the pushing plate position adjustment portion 861 for moving the pushing plate 803 in a direction perpendicular to the conveying direction may be provided, and the position of the pushing plate 803 may be moved so that the position with respect to the folding score S-C may be shifted.

Figure 16B:
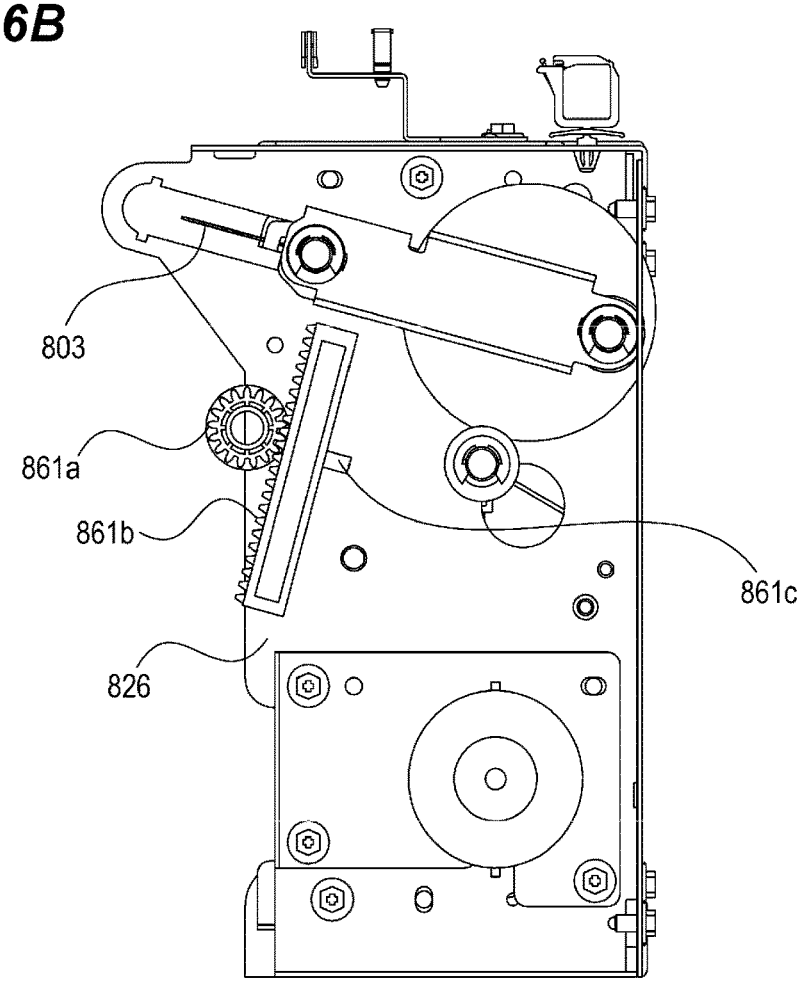
Figure 17:
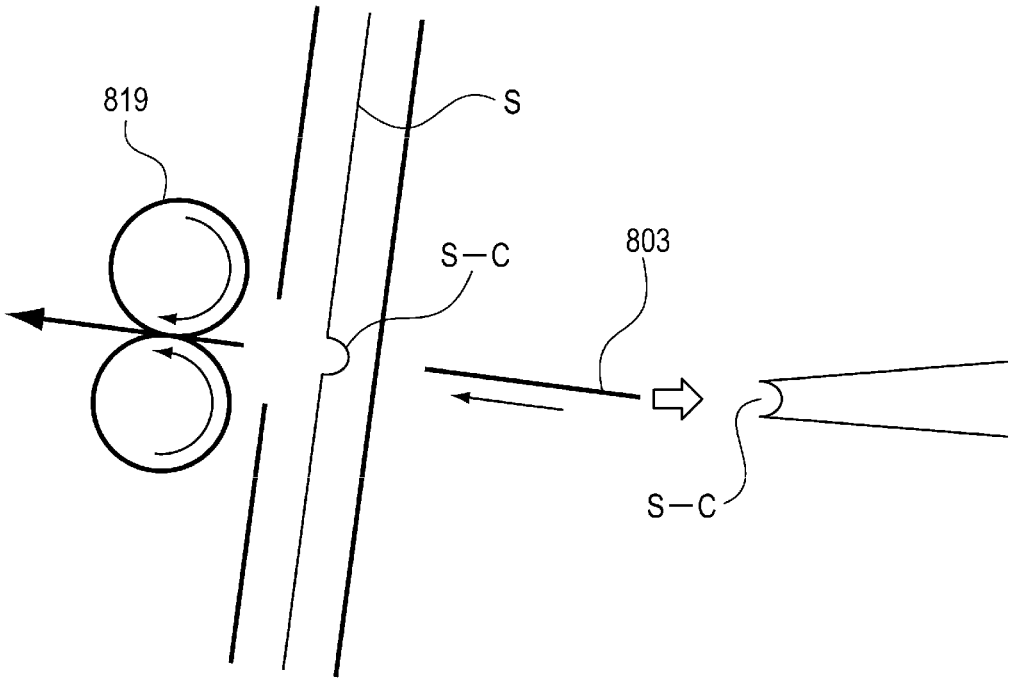
FIG. 17 is an explanatory diagram showing a folding score and a folding state.

As shown in FIG. 16B, such pushing plate position setting mechanism can be configured such that the driving force of a motor (not shown) is transmitted to the pushing plate moving portion 861*b* via the driving force transmission gear 861*a*, thereby moving the front side pushing frame 826 including the pushing plate 803. Further, the position at which the pushing plate positioning portion 861*c* blocks the pushing plate position detecting sensor (not shown) is set as a home position, and the pushing plate 803 and the folding score S-C are shifted by driving the motor for a predetermined number of pulses from that position.

Further, as another example of the pushing position setting mechanism, the configuration can be adopted in which the position of the folding score S-C with respect to the sheet is adjusted. Even with this configuration, the folding score S-C and the pushing plate 803 are shifted thereby obtaining the same effect. In the previously explained example, it is assumed that the folding score S-C is formed at the center portion of the sheet in the sheet conveying direction. However, in the case of changing the position of the folding score S-C, a booklet which is folded at a position deviated from the center is obtained.

When realizing this embodiment, the configuration can be adopted in which the sheet S is stopped at a position at which the center of the sheet S is deviated from the center of the scoring portion 202 by the deviation amount based on the sheet detecting result of the position sensor 203 and the conveying length of the sheet S, and a score is formed by the scoring portion 202 in the scoring device 200 shown in FIG. 1.

In the embodiment in which the position of the folding score is adjusted, the score processing is performed on the sheet by the scoring device 200 and the information of this score processing is transmitted to the sheet processing apparatus 300 via the CPU 401, thereby switching the control. However, it is also possible to provide a scoring unit in the sheet processing apparatus 300, and to switch the presence/absence of the score processing in the sheet processing apparatus and the position of the pushing and folding.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2016-138153, filed Jul. 13, 2016, which is hereby incorporated by reference herein in its entirety.

What is claimed is:

1. A sheet processing apparatus, comprising:

a supporting portion on which a sheet which has been conveyed is supported;

a pushing member configured to push the sheet with an abutting portion of the pushing member in order to fold the sheet on the supporting portion; and a setting portion configured to set a pushing position at which the pushing member pushes the sheet with a score to a position at which the sheet is to be folded at the score, wherein a center of the abutting portion does not coincide with a center of the score of the sheet.

2. The sheet processing apparatus according to claim 1, wherein the pushing position is set by the setting portion such that a centerline of the abutting portion is separated from a centerline of the score of the sheet by ½ of a thickness of the abutting portion or more and a part of the abutting portion is within a folding range of the score.

3. The sheet processing apparatus according to claim 1, wherein given that a thickness of the abutting portion is t, a width of the score is b, and a thickness of the sheet is tp, the pushing position is set by the setting portion such that a deviation mount between a centerline of the abutting portion and a centerline of the score of the sheet meets the following condition:

$$t/2 < \text{the deviation amount} < b/2 + t/2 + tp.$$

4. The sheet processing apparatus according to claim 1, wherein the setting portion is configured to adjust a relative position between the score of the sheet supported on the supporting portion and the pushing member.

5. The sheet processing apparatus according to claim 4, wherein the supporting portion includes a regulating portion configured to position the sheet in a sheet conveying direction by supporting an end portion of the sheet which has been conveyed, and wherein the setting portion is configured to adjust the pushing position of the pushing member by adjusting a position of the regulating portion.

6. The sheet processing apparatus according to claim 4, wherein the setting portion is configured to adjust the pushing position of the pushing member by adjusting a position of the pushing member.

7. The sheet processing apparatus according to claim 4, wherein the setting portion is configured to adjust the pushing position of the pushing member by adjusting a position of the score to be formed on the sheet.

8. The sheet processing apparatus according to claim 1, wherein when the sheet with the score is pushed by the pushing member, the setting portion is configured to set the pushing position to a position at which the score is pushed and when a sheet without a score is pushed by the pushing member, the setting portion is configured to set the pushing position to a position at which a folding position of the sheet coincides with a centerline of the abutting portion.

9. An image forming apparatus, comprising:

an image forming portion configured to form an image on a sheet;

a scoring portion configured to form a score on the sheet;

a supporting portion on which the sheet on which an image has been formed by the image forming portion is supported;

a pushing member configured to push the sheet with an abutting portion of the pushing member in order to fold the sheet supported on the supporting portion; and a setting portion configured to set a pushing position at which the pushing member pushes the sheet with the score to a position at which the sheet is to be folded at the score, wherein a center of the abutting portion does not coincide with a center of the score of the sheet.

* * * * *